United States Patent [19]

Andrews, Jr.

[11] Patent Number: 4,655,537

[45] Date of Patent: Apr. 7, 1987

[54] COMPLIANT SECTION FOR CIRCUIT BOARD CONTACT ELEMENTS

[75] Inventor: Howard W. Andrews, Jr., Hershey, Pa.

[73] Assignee: AMP Incorporated, Harrisburg, Pa.

[21] Appl. No.: 858,848

[22] Filed: Apr. 30, 1986

Related U.S. Application Data

[63] Continuation of Ser. No. 726,212, Apr. 23, 1985, abandoned, which is a continuation-in-part of Ser. No. 523,505, Aug. 15, 1983, abandoned.

[51] Int. Cl.[4] ..... H01R 13/42

[52] U.S. Cl. ..... 339/221 R; 339/17 C

[58] Field of Search ..... 339/17 C, 220 R, 221 R, 339/221 M, 252 R, 252 P

[56] References Cited

U.S. PATENT DOCUMENTS

| | | | |
|---|---|---|---|
| 3,634,819 | 1/1972 | Evans | 339/252 P |
| 4,066,326 | 1/1978 | Lovendusky | 339/221 M |
| 4,186,982 | 2/1980 | Cobaugh et al. | 339/221 M |
| 4,446,505 | 5/1984 | Long et al. | 339/221 R |

*Primary Examiner*—Eugene F. Desmond
*Assistant Examiner*—Gary F. Paumen
*Attorney, Agent, or Firm*—Allan B. Osborne

[57] ABSTRACT

The present invention relates to compliant sections utilized on contact elements which are mounted in plated-through holes in printed circuit boards, generally in conjunction with card edge and other electrical connectors. More particularly, the invention disclosed includes two elongated spring members having generally centrally located, load-receiving segments so that forces exerted against the spring members are more uniformly distributed along the lengths thereof.

3 Claims, 6 Drawing Figures

COMPLIANT SECTION FOR CIRCUIT BOARD CONTACT ELEMENTS

This application is a continuation of application Ser. No. 726,212 filed Apr. 23, 1985, now abandoned which is a continuation-in-part of application Ser. No. 523,505 filed Aug. 15, 1983, now abandoned.

U.S. Pat. No. 3,634,819 discloses a contact element having a compliant section which may be inserted in a plated-through hole in a circuit board. The compliant section includes two resilient or spring members, located intermediate the ends, having an arcuate configuration, forming a shape similar to an eye of a needle. The periphery of the compliant section is greater than the plated-through hole which receives it so that the section is compressed upon being inserted thereinto. The spring members will maintain the contact element in position and further will also provide an excellent electrical connection.

The present invention is intended to provide an electrical contact element of the above kind which is substantially improved to yield better retention and electrical connection.

A contact element as defined in the first paragraph of this specification is, according to the present invention therefore, characterized in that the compliant section is provided with a pair of spaced apart, spring members with each member having two vertical segments, one spaced below and inwardly of the other, and joined to each other and to the upper and lower sections of the contact element by obliquely extending segments.

For a better understanding of the invention, reference will now be made, by way of example, to the accompanying drawings, in which:

FIG. 1 is an isometric view of the compliant section of a contact element incorporating the features of the present invention;

FIG. 1-A is a view of an alternate embodiment of the compliant section of the present invention;

Figure 1:
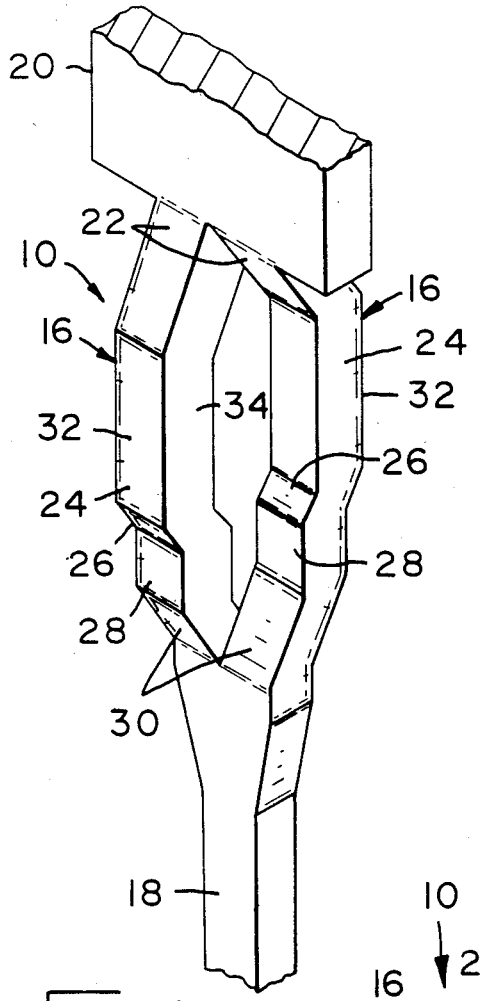
Figure 1A:
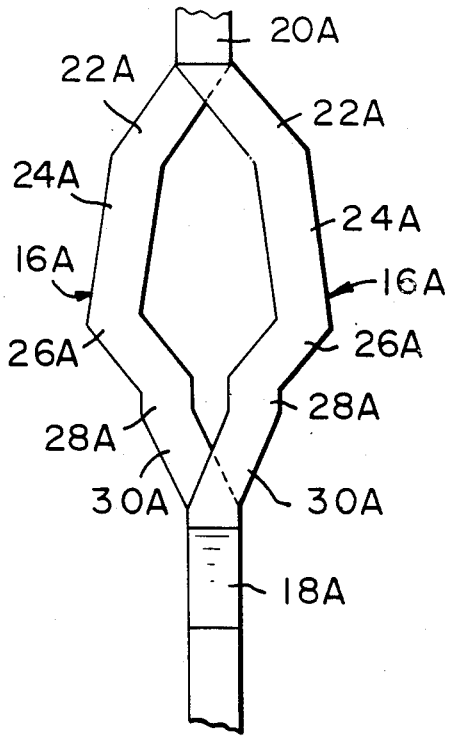

Compliant section 10, shown in the several drawings, may be included into any one of several different contact elements for pins which are mounted in plated-through holes 12 (FIGS. 2–5) in printed circuit board 14 or the like. The compliant section 10 is that part of an element or pin which is driven into plated-through hole 12 and retained therein by the resilient characteristics of the section 10. Two most important aspects of a compliant section 10 is the force required to insert it into hole 12 and the force required to withdraw it from the hole. Although the two are related through a given range for a particular design and metal used, the relation may not hold at the higher extremes. For example, it was found that one design required such a high insertion force that the resilient or spring members were deformed and the resulting configuration resulted in giving the section a taper pin effect; i.e., the contact element could be withdrawn without effort after only a slight dislodging motion.

Other problems noted include the finding that certain designs had no compliancy because the spring members could not bend or flex as the section was being driven into the hole. Contra, highly resilient spring members flexed so readily that the contact element, mounted in the board, could be moved or rocked back and forth quite easily, thereby causing electrical discontinuities.

The compliant section 10 of the present invention overcomes the above and other problems. The major structural features of compliant section 10 includes two spring members 16, positioned between a tail section 18 (note, however, that compliant section 10 could be the lowest part of the contact element) and an upper contact section 20. As these sections 18,20 can be of any shape and are not directly important to the present invention, they are not completely shown.

Compliant section 10 is formed by longitudinally shearing a flattened portion of stock (not shown) and then forcing the two legs; i.e., spring members 16, apart so that they are on opposite sides of a first plane containing a longitudinal axis of the contact element.

Concurrent with the aforementioned shearing, spring members 16, each being identical to the other, are formed to include five integral segments 22, 24, 26, 28 and 30.

The uppermost segments, indicated by reference numeral 22, are attached to section 20 and extend downwardly (towards tail section 18) and obliquely outwardly therefrom. Elongated second segments 24 extend axially downwardly from their attachment to the first segments 22. Third segments 26, extending downwardly and obliquely inwardly; i.e., towards each other, connect the elongated second segments 24 with a shorter axially extending segments 28. Segments 26 position these fourth segments 28 inwardly relative to second segments 24. The fifth and last segments 30 extend downwardly and obliquely inwardly to their attachment with tail section 18. The first and fifth segments 22,30, may also be referred to as the root sections or segments.

Figure 3:
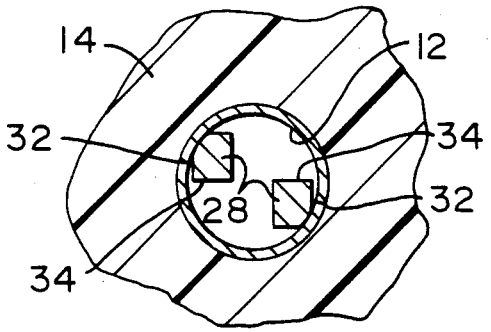
FIG. 3 is a cross-sectional view taken along line 3—3 of FIG. 2.

Second and fourth segments 24,28 respectively, are shown in FIGS. 1 and 3 as being generally parallel to the longitudinal axis of the compliant section 10. An alternative embodiment is shown in FIG. 1-A wherein second segments 24A slant outwardly in the downward direction. Fourth segments 28A are formed to be generally parallel to the longitudinal axis. However, the other segments 22A, 26A and 30A are somewhat distorted relative to similar segments 22,26 and 30 shown in the embodiment of FIG. 1.

Figure 4:
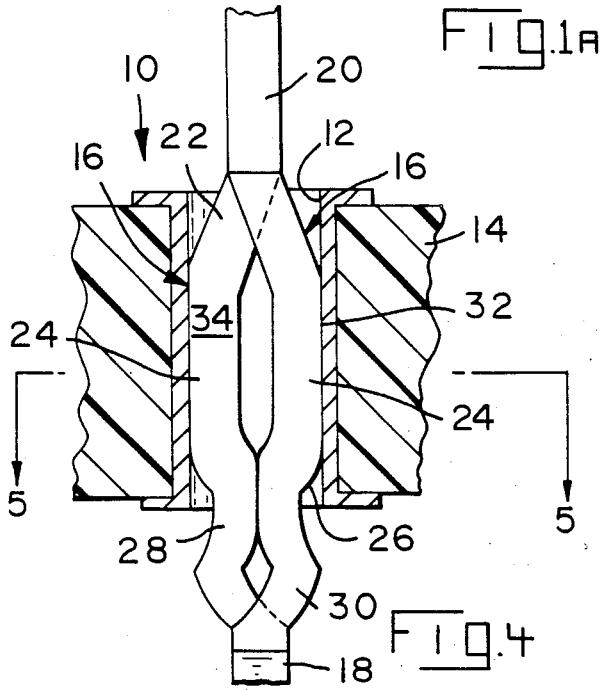
FIG. 4 is a view of the compliant section of FIG. 1 positioned fully in a plated-through hole.
Figure 5:
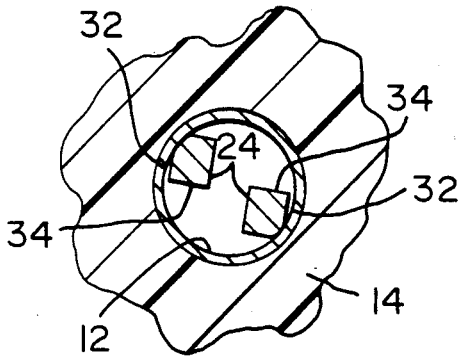
FIG. 5 is a cross-sectional view taken along lines 5—5 of FIG. 4.

The outwardly facing surfaces 32 of the spring members 16 are preferably non-symmetrically curved from side to side; i.e., transverse to the axis of contact element 10. The cross-sectional drawings in FIGS. 4 and 5 show this curvature.

The inner surfaces 34; i.e., the surfaces created when spring members 16 were defined by shearing, are on a second plane perpendicular to the aforementioned first plane.

The overall configuration of the two spring members 16 are such as to define an angular bowed compliant section with a disruption therein occasioned by the fourth, shorter vertical segments 28.

Figure 2:
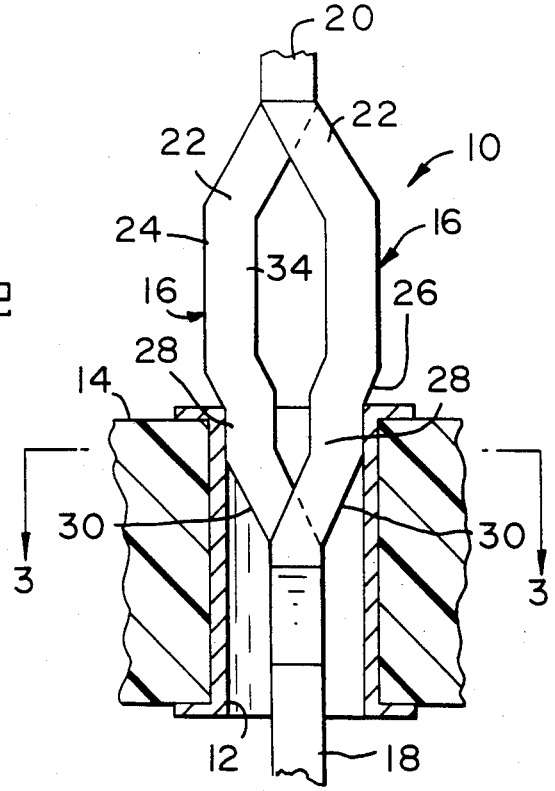
FIG. 2 is a view of the compliant section of FIG. 1 positioned partially in a plated-through hole in a circuit board.

The insertion of compliant section 10 into plated-through hole 12 is a two stage operation resulting in transferring the maximum beam loading or deflection point to the more resilient center segments 24. With reference to FIG. 2, as spring members 16 enter hole 12 in the first stage, segments 30 engage the wall thereof, only slightly increasing the minimal insertion force required if hole 12 is a minimum size hole. FIG. 3 shows the relative position of segments 28 at this stage.

Insertion forces increase as obliquely extending segments 26 enter hole 12 and are pressed inwardly, deforming segments 28 and 30. The deformation is accentuated in that the attachment of segments 30 to tail section 18 is fixed and cannot flex in the manner of a hinge. Concurrently, as segments 26 enter, twisting of spring members 16 about their longitudinal axis begins. As the twisting becomes more pronounced, inside edges of segments 28 collide. This interference results in even more deformation. FIG. 4 shows how segments 26, 28 and 30 are deformed.

The second stage begins as elongated segments 24 enter hole 12. Being resilient, segments 24 move in more readily to fit within hole 12; i.e., the insertion force drops somewhat. As segments 24 seat in hole 12, the insertion force levels off and its magnitude at that point is the force required to pull compliant section 10 out; i.e., the retention force.

The advantage gained in shifting the loading to segments 24 is that spring members 16 can enter smaller size holes 12 without substantial distortion thereto. Alternatively, spring members 16 may be made stronger to increase their retention force.

As shown in FIG. 4, during the second stage inside surfaces 34 on segments 22 meet and slide against each other.

Shifting or transferring the loading to segments 24 increases the range of deflection thereof. In addition, the aforementioned twisting further increases the deflection range by reducing the amount of required deflection by segments 24 in entering hole 12. That is, as a person twists sideways to pass through a narrow opening, the segment twisting re-orientates segments 24 so as to enter hole 12 with less inward movement towards each other. Accordingly, more inward deflection is available than in the absence of twisting. FIG. 5 shows how the twisting moved segments 24 relative to each other.

Central loading occurs whether plated-through hole 12 is of maximum, minimum or intermediate diameter. In a maximum diameter condition, the two lower segments 28 and 30 will enter hole 12 under substantially no insertion force. Loading, i.e., pressure exerted by the wall, begins against the oblique surfaces on third segments 26 as they engage the wall of hole 12. In a minimum diameter hole, loading still begins with segments 26 but some insertion force will be required to slide the compliant section in that far, particularly if manufacturing tolerances are too loose.

Another advantage gained through the novel compliant section structure disclosed herein is that kinking, i.e., the aforementioned taper pin effect, of spring members 16 are avoided such as may occur when the loading point is adjacent one fixed end.

I claim:

1. An electrical contact element for mechanical and electrical connection with a plated-through hole in a printed circuit board comprising:

a contact section, a tail section and a compliant section disposed therebetween, said compliant section having a pair of spring members joined at both ends to the contact and tail sections, and each having a plurality of segments and inner surfaces, each spring member, prior to being inserted into the plated-through hole, extends outwardly from each other on opposite sides of a first plane containing a longitudinal axis of the electrical contact element and with the inner surfaces being disposed in a second plane perpendicular to the first plane and further only the end-most portions of each spring member extend across the first plane vis-a-vis attachment to the contact and tail sections, said segments of the spring members including:

first segments being attached to the contact section and extending obliquely outwardly from the longitudinal axis and from each other, second segments being attached at one end to the first segments and extending substantially parallel to the longitudinal axis, third segments being attached at one end to the second segments and extending obliquely inwardly towards the longitudinal axis and towards each other, fourth segments being attached at one end to the third segments and extending substantially parallel to the longitudinal, axis and are spaced closer thereto than the second segments; and fifth segments being attached at one end to the fourth segments and to the tail section and extending obliquely inwardly towards the longitudinal axis and towards each other;

said second, third and fourth segments being spaced from the first plane so that space is provided between the spring members.

2. The electrical contact element of claim 1 wherein the fifth segments of the spring members bend when the compliant section is positioned within the plated-through hole.

3. The electrical contact element of claim 1, wherein the second segments have outer radiused contact surfaces for engagement with the plated-through hole when the compliant section is inserted therein.

* * * * *